US005305882A

United States Patent [19]

Kaplan et al.

[11] Patent Number: 5,305,882

[45] Date of Patent: Apr. 26, 1994

[54] SELF-STORING COLLAPSIBLE IMPLEMENT

[76] Inventors: Alan F. Kaplan, 101 Grove St., Chestnut Hill, Mass. 02167; Saul H. Garlick, 35 Woodledge Rd., Needham, Mass. 02192

[21] Appl. No.: 20,265

[22] Filed: Feb. 18, 1993

Related U.S. Application Data

[63] Continuation of Ser. No. 805,848, Dec. 10, 1991, abandoned.

[51] Int. Cl.[5] ..... A46B 5/02; A46B 17/00; A45D 44/18; B65D 25/28

[52] U.S. Cl. ..... 206/349; 206/15.3; 15/184; 15/144.4; 312/207; D6/551; 16/115; 4/255.09

[58] Field of Search ..... 4/255.01, 255.05, 255.08, 4/255.09, 255.11; 312/206, 207; 16/115; 206/15.2, 15.3, 349, 362, 362.1, 362.2, 362.3, 372, 373, 374, 375; 15/144 B, 184, 144 R; 68/215, 219; D6/551

[56] References Cited

U.S. PATENT DOCUMENTS

| | | | |
|---|---|---|---|
| 967,236 | 8/1910 | Ramey | 15/184 |
| 1,138,244 | 5/1915 | Parker | 15/144 B |
| 1,406,841 | 2/1922 | Foss | 15/144 B |
| 2,448,603 | 9/1948 | Kevin et al. | 312/207 X |
| 2,545,091 | 3/1951 | Livermore | 206/361 |
| 2,757,787 | 8/1956 | Sergent | 206/361 |
| 2,984,852 | 5/1961 | George | 15/144 B |
| 3,278,965 | 10/1966 | Frazier | 15/184 |
| 3,866,257 | 2/1975 | Cansdale, Sr. | 15/144 B |
| 3,952,341 | 4/1976 | Cain | 4/255.01 |
| 3,994,032 | 11/1976 | Spickofsky | 4/255.11 |
| 4,031,673 | 6/1977 | Hagelberg | 206/15.3 |
| 4,033,650 | 7/1977 | Alissandratos | D6/524 X |
| 4,135,274 | 1/1979 | Freeman | 15/144 B |
| 4,238,860 | 12/1980 | Dixon | 4/255.08 |
| 4,317,605 | 3/1982 | Alissandratos | 312/206 |
| 4,653,142 | 3/1987 | Upton | 16/115 |
| 4,745,641 | 5/1988 | Tash | 4/255.11 |
| 4,793,646 | 12/1988 | Michaud, Jr. | 15/144 B |
| 4,866,809 | 9/1989 | Pelletier | 15/167.1 |
| 4,958,871 | 9/1990 | Hemans | 15/257.1 |

FOREIGN PATENT DOCUMENTS

| | | | |
|---|---|---|---|
| 622195 | 6/1961 | Canada | 206/15.2 |
| 246712 | 11/1987 | European Pat. Off. | 15/144 B |
| 179774 | 6/1962 | Sweden | 15/144 B |
| 590855 | 7/1947 | United Kingdom | 15/144 B |

*Primary Examiner*—William I. Price
*Attorney, Agent, or Firm*—Joseph S. Iandiorio

[57] ABSTRACT

A self-storing collapsible implement includes: a collapsible handle; a grip at the proximal end of the handle; a tool at the distal end of the handle; and a cover, attached to the handle proximate the junction of the grip and the handle for covering and concealing the tool when the handle is collapsed.

15 Claims, 5 Drawing Sheets

SELF-STORING COLLAPSIBLE IMPLEMENT

This is a continuation of application Ser. No. 07/805,848, filed Dec. 10, 1991 and now abandoned.

FIELD OF INVENTION

This invention relates to a self-storing collapsible implement such as a toilet bowl plunger or brush.

BACKGROUND OF INVENTION

Conventional toilet bowl plungers and brushes are generally unsightly, unsanitary, messy and clearly not eye-appealing. Plungers generally have long wooden handles which are highly visible if stored in the open at or around the toilet, which is generally the preferred storage location in order to minimize movement of the messy, dripping plunger between uses. Toilet bowl brushes, while often a bit smaller, are nonetheless large enough so that they cannot be unobtrusive when stored at or near the toilet, where they normally are kept for the same reasons as with respect to plungers.

SUMMARY OF INVENTION

It is therefore an object of this invention to provide a self-storing collapsible implement such as a toilet bowl plunger or brush.

It is a further object of this invention to provide such a self-storing collapsible implement which in the collapsed state completely conceals the tool such as the plunger or brush.

It is a further object of this invention to provide such a self-storing collapsible implement which is small and unobtrusive in the collapsed, stored condition.

It is a further object of this invention to provide such a self-storing collapsible implement which can provide a leakproof container for storage.

It is a further object of this invention to provide such a self-storing collapsible implement in which the self-storing structure is a part of the implement itself.

It is a further object of this invention to provide such a self-storing collapsible implement which can be made decorative to better blend in and/or create a pleasant appearance.

It is a further object of this invention to provide such a self-storing collapsible implement which is more sanitary, neater and more appealing.

It is a further object of this invention to provide such a self-storing collapsible implement which provides a shield for the user's hand when the implement is being used.

The invention results from the realization that a truly effective collapsible self-storing implement can be effected by using a collapsible handle to support the tool and providing between the grip and handle a cover large enough to enclose the tool when the implement is collapsed.

This invention features a self-storing collapsible implement which includes a collapsible handle and a grip at the proximal end of the handle. A tool is disposed at the distal end of the handle, and there is a cover attached to the handle proximate the junction of the grip and the handle for covering and concealing the tool when the handle is collapsed.

In a preferred embodiment there may be a base cap for closing the bottom of the cover to contain the tool. At least one of the cover and base cap may include gripping means for engaging the cover and cap. The gripping means may include threads on the cover of the cap. The base cap may include a pedal extending outwardly for enabling immobilizing of the cap during engagement and disengagement with the cover. The handle may include spring means for biasing it toward the extended position, and there may be means for locking the handle in the extended position and in the collapsed position. The handle may include attachment means at its distal end for engaging with a tool such as a toilet bowl plunger or brush. The attachment means may include threads. The gripping means may include twist lock means. The twist lock means may include a member on each of the cover and base caps, each member having an inclined surface for mutual engagement with the other. The handle may include a plurality of sections and the means for securing may include for each pair of adjacent sections releasable detent means on one section and associated recess means on the other. The means for securing might also include pin means on one section and an associated slot means on the other, or cam means on one section and associated constraining means on the other.

DISCLOSURE OF PREFERRED EMBODIMENT

Other objects, features and advantages will occur to those skilled in the art from the following description of a preferred embodiment and the accompanying drawings, in which.

The invention may be accomplished with a self-storing collapsible implement which includes a collapsible handle that may be, for example, a conventional telescopic handle made of plastic or metal. There is a grip provided at the proximal end of the handle which may be a pistol grip and may be knurled or provided with any other enhanced frictional or gripping surface. There is a tool at the distal end of the handle, such as a toilet bowl plunger or a toilet bowl brush, which has a threads for engaging the threads at the distal end of the handle. Other means for engagement may be used and other tools may be applied to the implement. There is a cover which is attached to the handle proximate the junction of the grip and the handle for covering and concealing the tool when the handle is collapsed. The cover is necessarily large enough to contain the tool and is generally decorated to be appealing to the user. It may be plastic, metal or any other suitable material. In the general case, the entire device is circularly symmetrical about the longitudinal axis of the handle, so the handle, the grip and the cover are circularly symmetrical. The cover may appear as a generally cylindrical form.

If it is desirable to completely enclose the tool, a base cap may be provided which snugly receives the cover. Either the base cap or the cover may have a ribbed, frictional or other gripping means so that the cover and cap securely engage. The gripping means may be on one or both the cover and cap; for example, the gripping means may include threads on the outside of the cover and the inside of the cap. The base cap may include one or more tabs or pedals extending outwardly from it so that the user can step on it to immobilize the cap during engagement and disengagement with the cover. There may be a spring inside the telescopic handle which urges it into the extended position, and there may be means for locking it when it is in the extended position, for example spring-loaded detents which interlock each telescopic section with the adjacent section, and the uppermost section with the grip. The same detents may be used to secure the handle when it is in the collapsed condition with all of the telescopic sections nested one inside the other and ultimately inside the grip. Alternatively, a twist lock, threaded mechanism, or friction lock such as used in camera tripods could be used.

Figure 1:
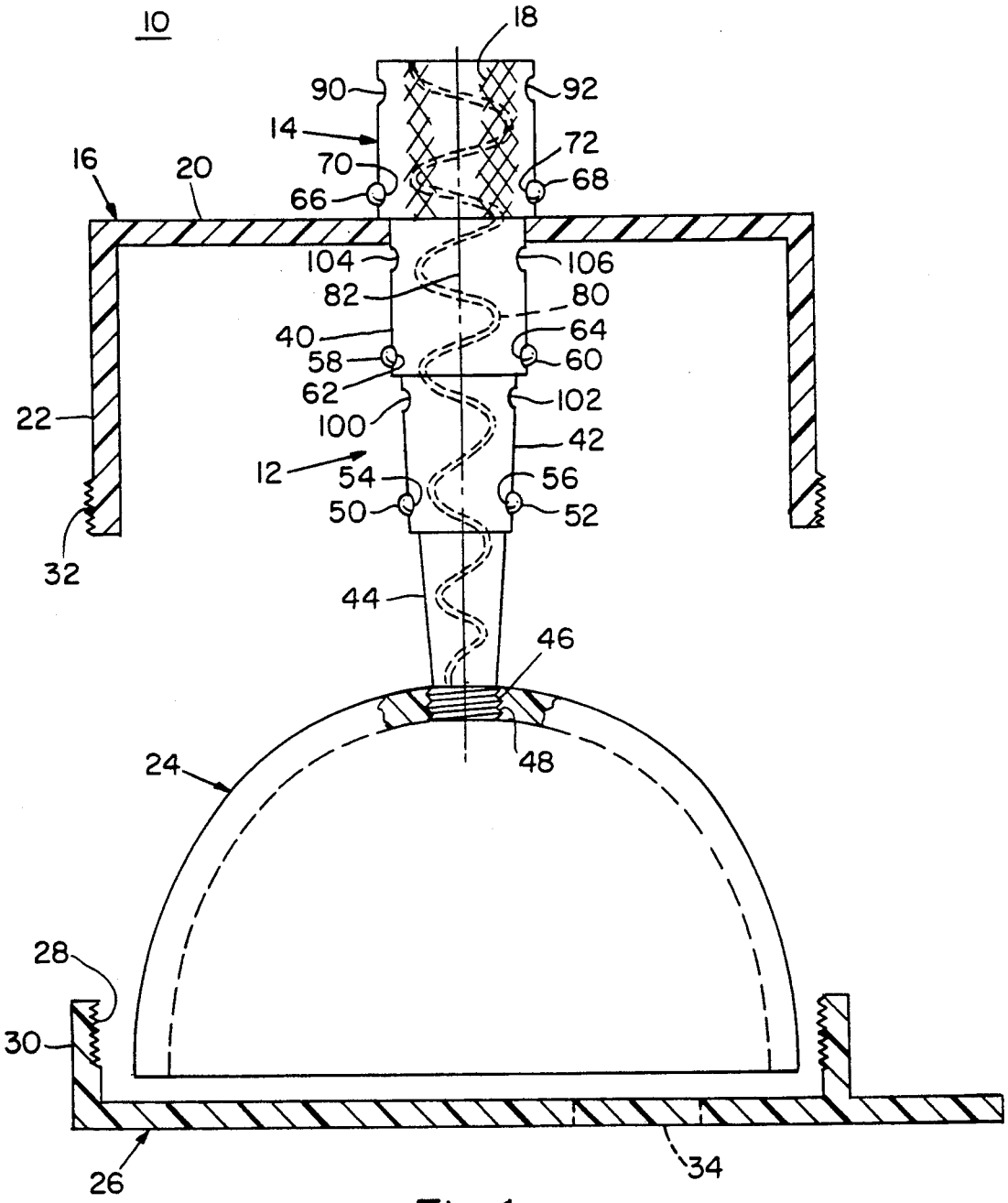
FIG. 1 is a schematic elevational view of the self-storing collapsible implement according to this invention.
Figure 2:
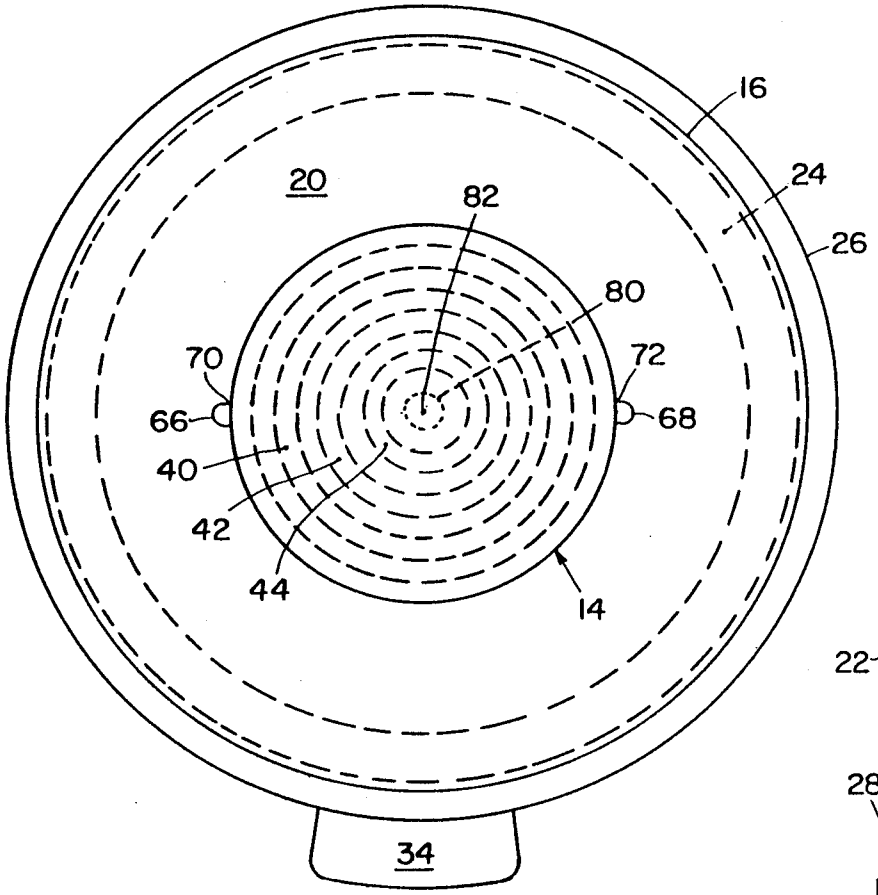
FIG. 2 is a top plan view of the implement shown in FIG. 1.

There is shown in FIGS. 1 and 2 a self-storing collapsible implement 10 according to this invention which includes telescopic handle 12, a grip 14 and a cover 16 attached at the junction of handle 12 and grip 14. Grip 14 is shown as having a knurled surface 18 for providing a secure grip. Cover 16 has a top portion 20 of sufficient radial extent and a side wall portion 22 of sufficient length so that it completely covers toilet bowl plunger 24 when implement 10 is collapsed. Base cap 26 includes threads 28 on the inner surface of its upstanding wall 30 which engage with similar threads 32 on the outer surface of wall 22, so that a complete closure can be formed from cover 16 and base cap 26 to conceal plunger 24. Base cap 26 may include a pedal or tab 34, shown to better advantage in the plan view of FIG. 2. Pedal 34 is stepped on by the user to immobilize base cap 26 when engaging or disengaging cover 16 with base cap 26. FIG. 2 also illustrates the circular concentric structure of the implement of the disclosed embodiment. However, this is not a necessary limitation of the invention, as the tool and/or the cover handle and cap may have any desired geometric configuration: triangular, square, rectangular, polygonal, or even irregular shapes.

Telescopic handle 12, FIG. 1, includes three sections 40, 42 and 44, although more or fewer may be used. Section 44 includes threads 46 at its distal end for engaging with similar threads 48 of the toilet bowl plunger 24 or other tool, such as toilet brush or the like. Handle 12 is locked in the extended position shown in FIG. 1, by detents 50, 52 carried by section 44 which engage with holes 54 and 56 in section 42 detents 58 and 60 carried by section 42 which engage with detent holes 62 and 64 in section 40; and detents 66 and 68 which engage with detent holes 70 and 72 in grip 14. A spring 80, shown schematically, extending generally in the direction of the central longitudinal axis 82, urges sections 40, 42 and 44 to the extended position.

Figure 3:
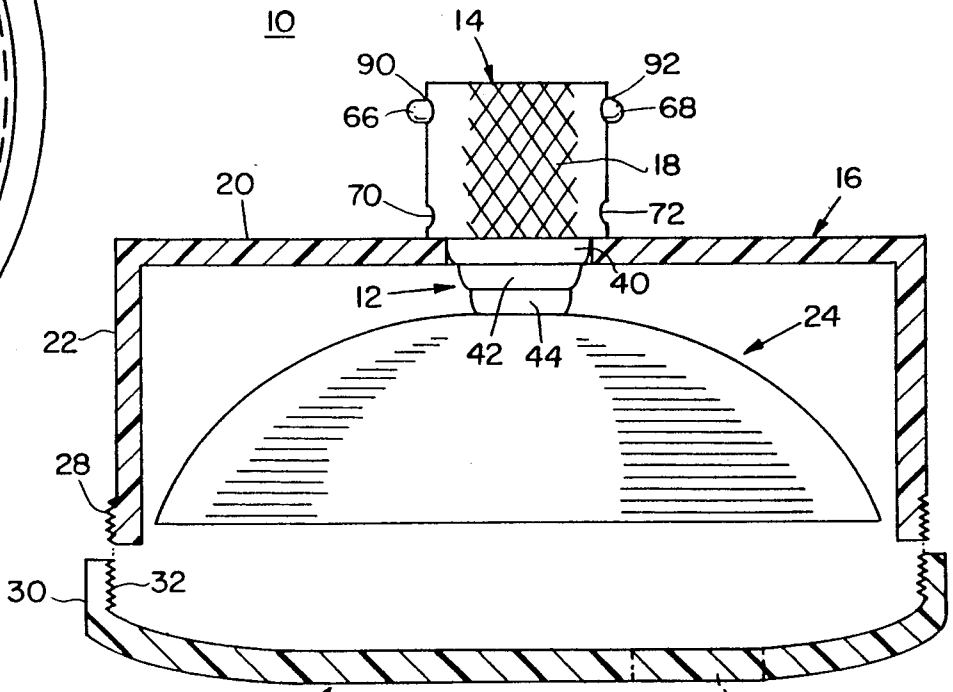
FIG. 3 is a view similar to FIG. 1 with the implement in the collapsed position.

In the collapsed position, implement 10 appears as at FIG. 3, with sections 44, 42 and 40 compactly nested one inside the other and all inside grip 14. FIG. 3 is a slight variation on the shape of base cap **26*a* as shown where the cap has a generally convex lower portion. Also in FIG. 3 it can be seen that detents 66 and 68 no longer engage with detent holes 70 and 72 on the lower portion of grip 14. Rather, they now engage with the detent holes 90, 92 at the upper end of grip 14**.

Figure 5:
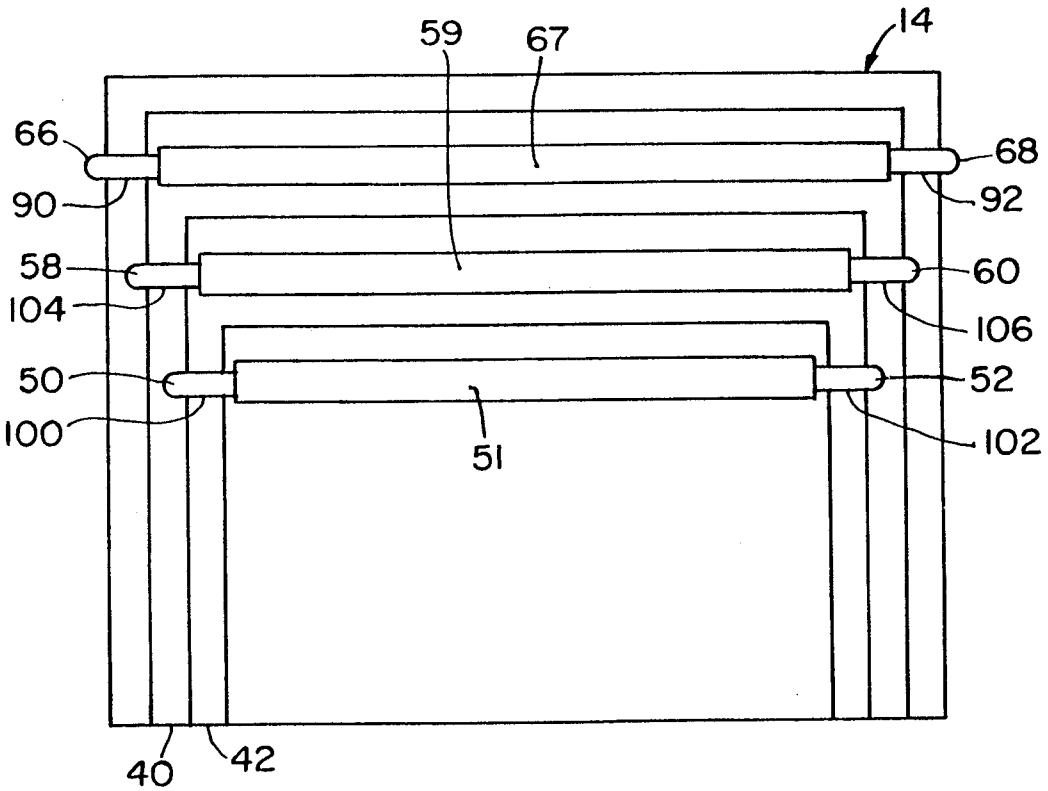
FIG. 5 is an enlarged detail view of the handle in the collapsed state as shown in FIG. 3, illustrating the mechanism for securing the handle in the collapsed position.
Figure 4:
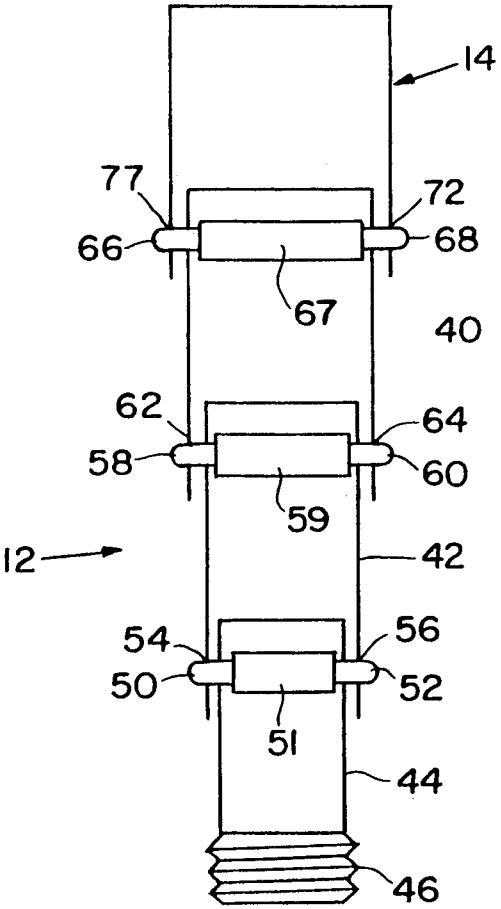
FIG. 4 is a schematic view of the handle in the extended position such as shown in FIG. 1, illustrating the locking mechanism which holds the handle in the extended position.
Figure 6:
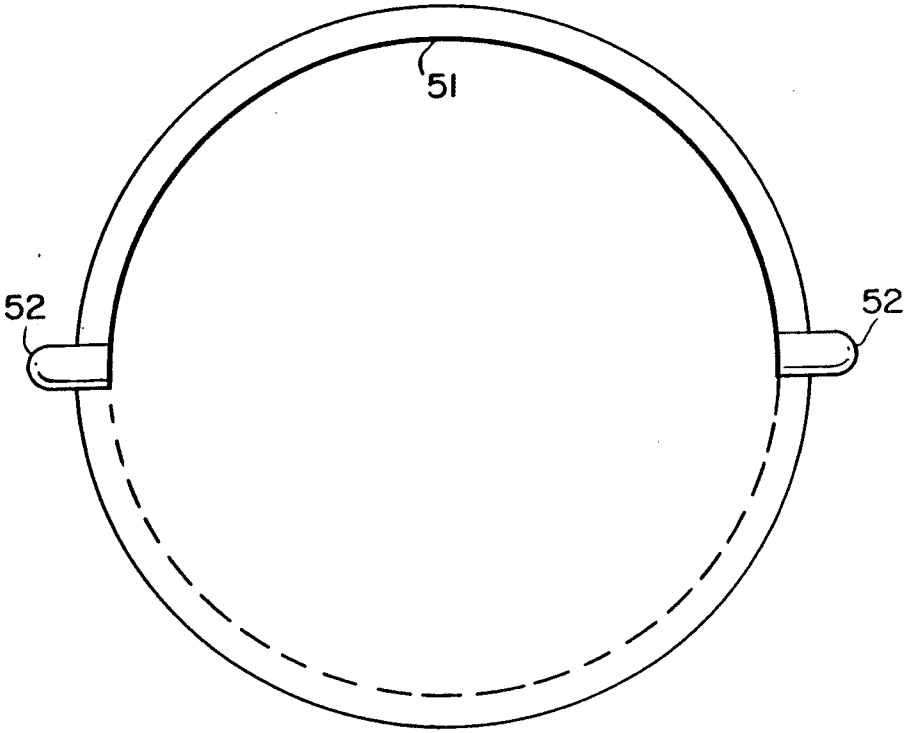
FIG. 6 is a top plan view of one of the sections of the telescopic handle showing the spring-loaded detents which act as the locking and securing mechanisms for the handle in the extended and collapsed positions.

The telescopic mechanism including the spring that urges it into the extended position, the detents that lock it in the extended position, and the detents that secure it in the collapsed position, may be any of a number of different conventional mechanisms well known for this purpose, but for purposes of completeness a schematic diagram of one implementation is shown in FIGS. 4, 5 and 6.

In the extended position, FIG. 4, detents 50, 52; 58, 60; and 66, 68, carried by each of the segments 44, 42 and 40, respectively, engage with detent holes 54, 56; 62, 64; and 70, 72, respectively, in the lower portions of sections 42 and 40 and grip 14.

In the collapsed state, as shown in FIG. 5, these same detents 50, 52; 58, 60; and 66, 68 are engaged with detent holes at the upper end of each of the next higher sections. Detents 50 and 52, carried by section 44, are engaged with the upper detent holes 100 and 102 in section 42. Detents 58 and 60, carried by section 42, are engaged with the upper detent holes 104, 106 in section 40. Detents 66 and 68, carried by section 40, are engaged with the upper detent holes 90, 92 in grip 14. The relationship of the upper and lower detent holes in the various sections and the grip can be seen with respect to their depiction in FIGS. 1 and 4.

Pairs of detents 50, 52; 58, 60; 66, 68 may be mounted on spring steel bands 51, 59 and 67, respectively, depicted in FIGS. 4 and 5 and illustrated with respect to band 51 associated with detents 50 and 52 in FIG. 6. Thus as the detents 66, 68, then 58 and 60, and then 50 and 52, are squeezed inwardly in sequence, releasing them from the secured collapsed position afforded by engagement with detent holes 90, 92; 104,106; and 100, 102, respectively, spring 80 urges the sections outward to the extended position of FIGS. 1 and 4, until detents 66, 68; 58, 60; and 50, 52 engage with detent holes 70, 72; 62, 64; and 54, 56, respectively.

Figure 7B:
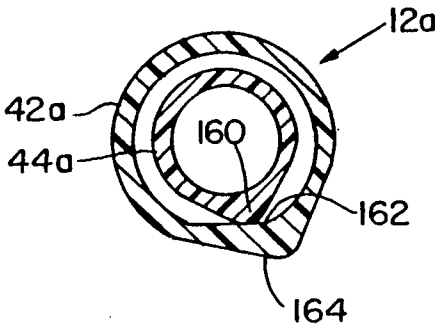
FIG. 7B is a sectional view taken along line 7B—7B of FIG. 7A.
Figure 7A:
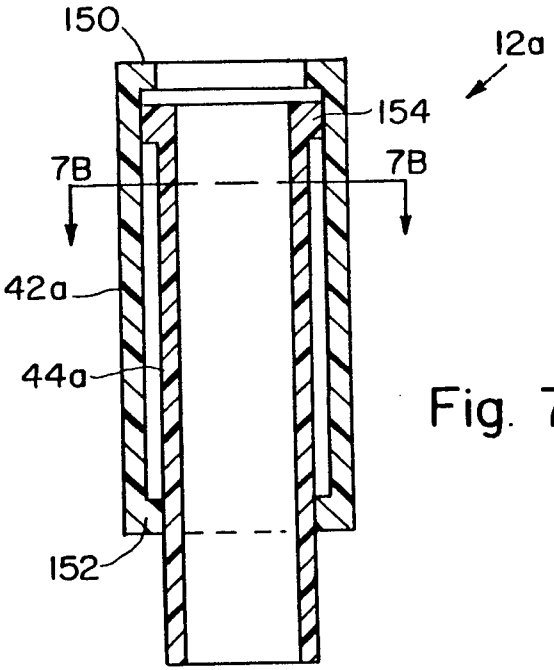
FIG. 7A is a side elevational view in section of two of the telescopic sections using an alternative construction.

Alternatively, telescopic handle **12*a*, FIG. 7A, may be formed of sections such as sections 42*a*, 44*a*, which include shoulders 150 and 152 on section 42*a* that limit the vertical motion of section 44*a* by virtue of its shoulder 154. Sections 42*a* and 44*a* may be locked in a collapsed or extended position by twisting each section relative to its adjacent section so that a camming surface 160, FIG. 7B, for example, on section 44*a*, jams against constraining section 162 on section 42*a*. Section 44*a* has a similar camming section 164** which upon rotation is jammed with the constraining surface on the next outer section (not shown).

Figure 8B:
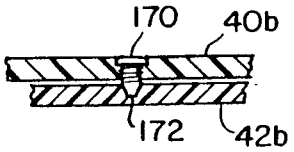
FIG. 8B is an enlarged detailed sectional view showing the engagement of the pin with a slot according to the mechanism shown in FIG. 8A.
Figure 8A:
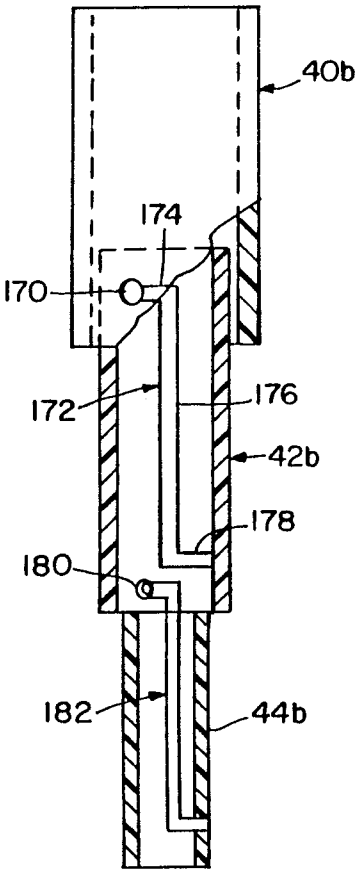
FIG. 8A is a side elevational view with portions broken away of an alternative construction of the handle using a pin and slot arrangement.

In another construction, FIG. 8A, pin 170 mounted on one section, for example section 40*b*, is engaged with a slot 172 in section 42*b* that has a horizontal open locking portion 174, a travel portion 176, and a horizontal collapsed locking portion 178 which guides the movement of pin 170. A similar pin 180 in section 42*b* cooperates with a similar slot 182 in section 44*b*. An enlarged more detailed view of pin 170 in section 40*b* and engaging slot 172 of section 42*b* is shown in FIG. 8B.

Figure 9A:
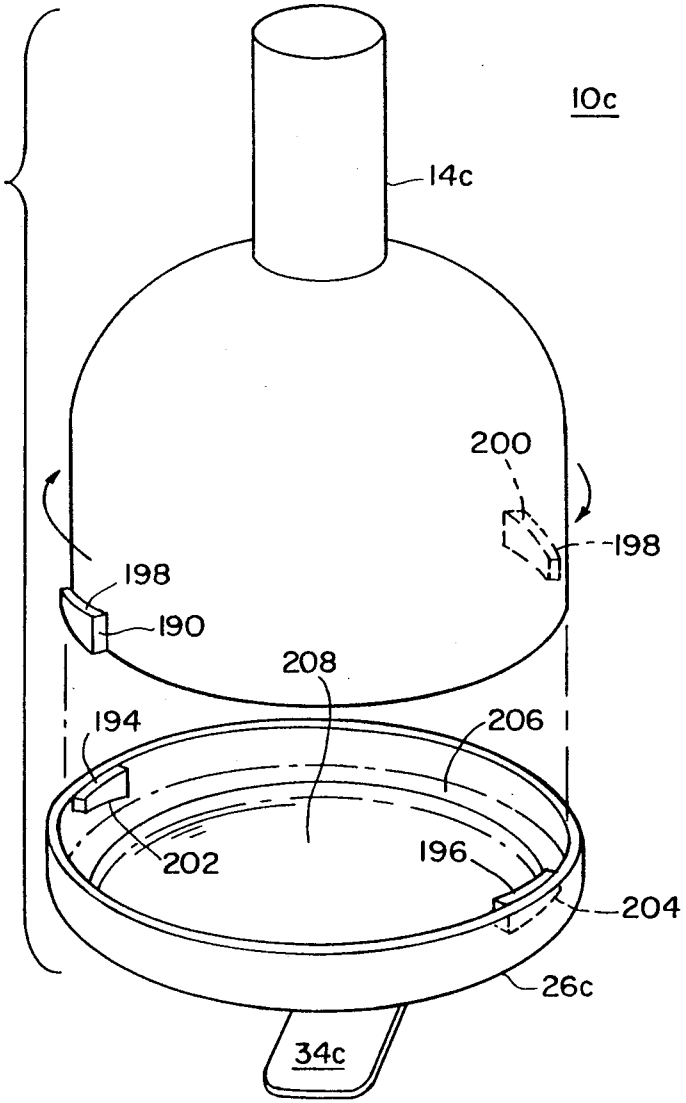
FIG. 9A is an exploded axonometric view of an alternative construction of the self-storing collapsible implement according to this invention.
Figure 9B:
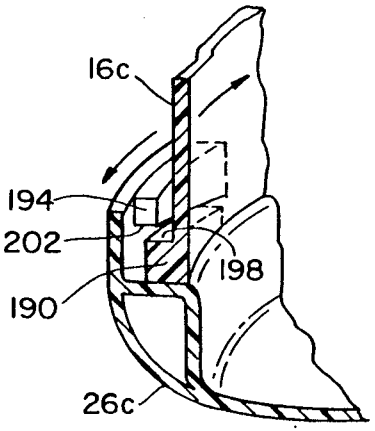
FIG. 9B is an enlarged detailed three-dimensional view of the locking mechanism used in the implement of FIG. 9A.

Cover 16 has only been shown threadably engaged with base cap 26. However, other means for engagement may be provided in accordance with the invention. For example, implement 10*c*, FIG. 9A, includes cover 16*c* that has a pair of ears or dogs 190, 192 which engage and lock with mating detents 194, 196 in base cap 26*c*. The upper surfaces 198 and 200 of ears or dogs 190 and 192 are inclined where they meet with complementarily inclined surfaces 202 and 204 of mating detents 194, 196, so that upon twisting of cover 16*c* ears and the detents become locked and also drive cover 16*c* against the bottom of base 26*c*, where there may be provided a sealing ridge 206 with a storage area 208 defined within ridge 206 where any residual liquid can collect without spilling out into the surrounding area. The interlocking action of the detents can be seen with respect to the enlarged view in FIG. 9B showing the engagement of detent 194 and ear 90.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A self-storing collapsible implement comprising:

a collapsible handle having a collapsible and an extended position;

a grip portion at the proximal end of said handle;

a tool at the distal end of said handle; and a cover, attached to the handle proximate the junction of said grip portion and said handle, for moving with said handle between the collapsed and extended positions;

said cover including a side wall and a top wall defining a cavity for receiving and covering said tool when said handle is in the collapsed state and exposing said tool when said handle is in the extended state.

2. The self-storing collapsible implement of claim 1 further including a base cap for closing the bottom of said cover to contain the tool.

3. The self-storing collapsible implement of claim 2 in which at least one of said cover and base cap includes gripping means for engaging the cover and cap.

4. The self-storing collapsible implement of claim 3 in which said gripping means includes threads on said cover and cap.

5. The self-storing collapsible implement of claim 2 in which said base cap includes a pedal extending outwardly for enabling immobilizing of said cap during engagement and disengagement with said cover.

6. The self-storing collapsible implement of claim 1 in which said handle includes spring means for biasing it toward the extended position.

7. The self-storing collapsible implement of claim 1 in which said handle includes means for securing it in the collapsed position and in the extended position.

8. The self-storing collapsible implement of claim 1 in which said handle includes attachment means at its distal end for engaging with a tool such as a toilet bowl plunger or brush.

9. The self-storing collapsible implement of claim 8 in which said attachment means includes threads.

10. The self-storing collapsible implement of claim 3 in which said gripping means includes twist lock means.

11. The self-storing collapsible implement of claim 10 in which said twist lock means includes a member on each of said cover and base cap, each member having an inclined surface for mutual engagement.

12. The self-storing collapsible implement of claim 7 in which said handle includes a plurality of sections and said means for securing includes for each pair of adjacent sections releasable detent means on one section and associated recess means on the other.

13. The self-storing collapsible implement of claim 7 in which said handle includes a plurality of sections and said means for securing includes for each pair of adjacent sections pin means on one section and associated slot means on the other.

14. The self-storing collapsible implement of claim 7 in which said handle includes a plurality of sections and said means for securing includes for each pair of adjacent sections cam means on one section and associated constraining means on the other.

15. A self-storing collapsible implement comprising:

a collapsible handle;

a tool at the distal end of said handle; and a cover affixed to the proximate end of said handle for moving with said handle as it collapses, said cover including means for automatically covering said tool as said handle is collapsed permitting utilization of said tool when said handle is extended and concealing said tool when said handle is collapsed.

* * * * *